US006068126A

United States Patent [19]

DeJonge

[11] Patent Number: 6,068,126

[45] Date of Patent: May 30, 2000

[54] PRESS TO LIFT FLAT PILL PACK

[75] Inventor: Stuart W. DeJonge, Easton, Pa.

[73] Assignee: Valley Design Inc., Bloomsbury, N.J.

[21] Appl. No.: 09/072,674

[22] Filed: May 6, 1998

[51] Int. Cl.[7] ..... B65D 83/04

[52] U.S. Cl. ..... 206/538; 206/528; 206/540; 220/282; 221/306; 221/312 C

[58] Field of Search ..... 206/528, 531, 206/533, 534, 534.1, 534.2, 535–538, 540; 220/281–283; 221/289, 303, 304, 306, 307, 309, 311, 312 B, 312 C, 312 R

[56] References Cited

U.S. PATENT DOCUMENTS

| | | | |
|---|---|---|---|
| 2,621,782 | 12/1952 | Reifers | 206/42 |
| 2,857,070 | 10/1958 | Elias | 220/24 |
| 3,061,082 | 10/1962 | Schenker | 206/42 |
| 3,159,308 | 12/1964 | Passavanti | 221/289 |
| 3,348,724 | 10/1967 | Rosso | 220/31 |
| 3,419,198 | 12/1968 | Pettersen | 222/541 |
| 3,601,250 | 8/1971 | Merila | 206/540 |
| 4,095,712 | 6/1978 | Perrella | 220/254 |
| 4,230,237 | 10/1980 | De Wit | 206/534.2 |
| 4,262,802 | 4/1981 | Laauwe | 206/540 |
| 4,354,619 | 10/1982 | Wippermann et al. | 206/540 |
| 5,205,424 | 4/1993 | Gaspar | 215/210 |
| 5,273,177 | 12/1993 | Campbell | 220/281 |
| 5,275,291 | 1/1994 | Sledge | 206/531 |
| 5,346,086 | 9/1994 | Harris | 220/254 |

*Primary Examiner*—Jim Foster
*Attorney, Agent, or Firm*—Kenneth P. Glynn, Esq.

[57] ABSTRACT

A flat pill pack container includes a main container body with a dispensing opening and an attachment mechanism for attaching a closed-biased, cover, and a defined dispensing chamber adjacent its dispensing opening. The closed-biased cover is attached at the dispensing opening in a first, closed position to prevent removal of pills from the main container body. The cover is movable to a second, open position to permit pill removal. The cover has a gate positioned in an open position when the cover is in its closed position, and the gate moves to a closed position when the cover is moved to its open position. A child resistant safety lock and/or a date indicator may also be included.

19 Claims, 4 Drawing Sheets

PRESS TO LIFT FLAT PILL PACK

BACKGROUND OF THE INVENTION

1. Field of the Invention

The present invention is directed to flat pill packs for convenient, controlled dispensing. Pills may be medicaments, candies, test pills, purifier pills or any other pill products that could be dispensed from a pill pack. These pills may take a conventional cylindrical shape or a capsule or any other shape.

2. Information Disclosure Statement

The following is representative of prior art relating to dispensing containers:

U.S. Pat. No. 3,348,724 to Charles Rosso shows a box of the hinged lid type which is constructed to be opened by pressing a portion of the lid which extends rearwardly beyond the hinge or fulcrum. The extension of the lid and an extension of the bottom wall of the box are connected by an envelope or body of resilient and flexible plastic material which holds the lid in position on the box and allows pressing of the lid extension to open the lid and also returns the lid to closed position when released.

U.S. Pat. No. 3,419,198 to Gunnar Nimrod Pettersen describes a plastic cap including a fastening portion for attachment to a bottle mouth and a cover. The cover is connected to the periphery thereof by flexible hinge means having a neutral position when the cover is open. Such portion has an outlet member remote from the hinge, and the cover a closing portion matching the outlet with frictional contact. A cover arm extends over the fastening portion from the closing portion to a point adjacent the hinge. By applying pressure to the arm when the cover is closed, the cover tilts about a fulcrum remote from the hinge releasing the frictional contact. Upon pressure release, the hinge swings the cover to open position.

U.S. Pat. No. 4,095,712 to Emilio Perrella illustrates a container for distributing solid loose products such as lozenges, sugar coated sweets and the like. According to the invention the container comprises a containing body and a closure lid, which is formed by an at least partially resilient plastics material. The upper base of the lid includes a delivery port, which is closed by a flap element formed as a single piece with the remaining part of said upper base. Said remaining part is elastically deformable between rest and delivery positions in which said flap element closes and opens said delivery port, respectively.

U.S. Pat. No. 4,262,802 to Robert H. Laauwe shows a molded plastic pill box with a lid hinged by a living hinge at one side of its top so the box can be loaded by a pill manufacturer, the lid when swing closed, permanently locking against reopening. The lid has a pill dispensing opening and a child-resistant closure hinged by a living hinge to the other side of the box top and normally closing the dispensing opening. The box forms a package for the pills which can be sold by the pill manufacturer to a druggist, an adult purchaser being capable of opening the child-resistant closure for dispensing of the packaged pills. The entire box can be a one-piece molding for minimum cost.

U.S. Pat. No. 5,205,424 to Ruben C. Gaspar discloses a child resistant cap and container assemblage comprising a container and a cap member that is secured to the container so that it can not be removed without either breaking the cap member or damaging the seal that joins the cap member to the container. The cap member is provided with a nozzle having an internal locking means so that the contents of the container can not be accessed when the container is in its normal upright position. To access the contents in the container, the assemblage is tilted to disengage the locking means enabling the nozzle to be opened and permitting a user to access the contents of the container using only one hand.

U.S. Pat. No. 5,273,177 to Phillip J. Campbell illustrates a press-to-open dispensing closure with a flexible arcual top surface in convex orientation which includes a flexible, aperture cover having an arcuate hinging connection to the top surface. The hinging connection of the aperture cover articulates between a convexly arcuate closed condition and a concavely arcuate open position.

U.S. Pat. No. 5,275,291 to Larry C. Sledge shows a child-resistant, elderly friendly dispensing container comprising a housing having an opening in its top wall and a drawer which slidable fits in the housing. The drawer has a front cavity section and a rear latch section. The latch section includes a horizontally disposed resilient panel formed with an upward button which, when the drawer is closed, extends up through the opening in the top wall of the housing and forms an automatic latch, holding the drawer closed. In order to open the drawer, the button must be depressed and, at the same time, the drawer must be pulled out from the housing.

The top of the housing is formed, adjacent the opening for the button, with a relief zone into which the button moves when the drawer is in dispensing position and blocks further opening.

U.S. Pat. No. 5,346,086 to John Harris discloses a lid for a closed container incorporating an opening which can be closed by a door provided with side walls so that even when the door is open, the only access to the interior of the container is through a slot in a wall of the door unit. Needles or other sharps may be introduced through the opening into the container for safe storage. When the door is pushed down to close the opening, a two-part live hinge formed by grooves acts to bias the door into the closed position. Re-opening is achieved by pressing on the flange incorporating the grooves. A flap provides a secondary closure device.

Notwithstanding the prior art, the present invention is neither taught nor rendered obvious thereby.

SUMMARY OF THE INVENTION

The present invention is a flat pill pack container which includes a main container body having a bottom, top and sidewalls and an internal open height adapted to receive a plurality of pills having predetermined dimensions. The main container body has a dispensing opening and an attachment mechanism for attaching a closed-biased, cover. It also has a defined dispensing chamber adjacent its dispensing opening. The closed-biased cover is attached to the container at the dispensing opening in a first, closed position to prevent removal of pills from the main container body. The cover is movably attached so as to be movable to a second, open position to permit pill removal. The cover has a gate attached to which is positioned in a first; open position when the cover is in its closed position, and the gate moves to a second, closed position when the cover is moved to its open position. In preferred embodiments, a child resistant safety lock may be included, and/or a date indicator.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention flat pill pack container is a device for dispensing pills from a convenient, flat, pocket-friendly container which operates on a press-to-lift the cover principle. It also relies upon a gate feature which advantageously prevents accidental dispensing of an excess number of pills and operates automatically in conjunction with the cover. The present invention container also includes a dispensing chamber for preloading one or more pills and, when the cover is pressed to lift open, the gate automatically prevents additional pills from exiting the container.

Figure 2:
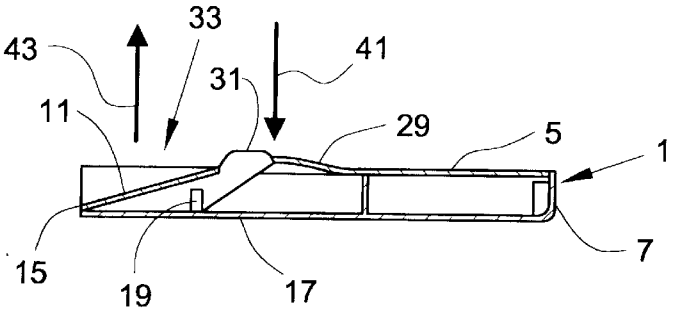
FIGS. 1, 2 and 3 show an oblique view, a side cut view and an oblique open view of a present invention flat pill pack container, without the gate shown, to illustrate some aspects of the functionality of the present invention.
Figure 3:
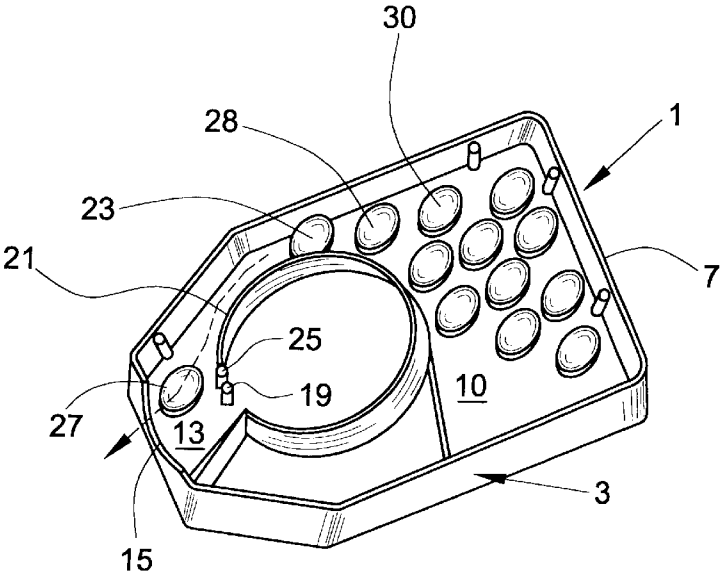
Figure 1:
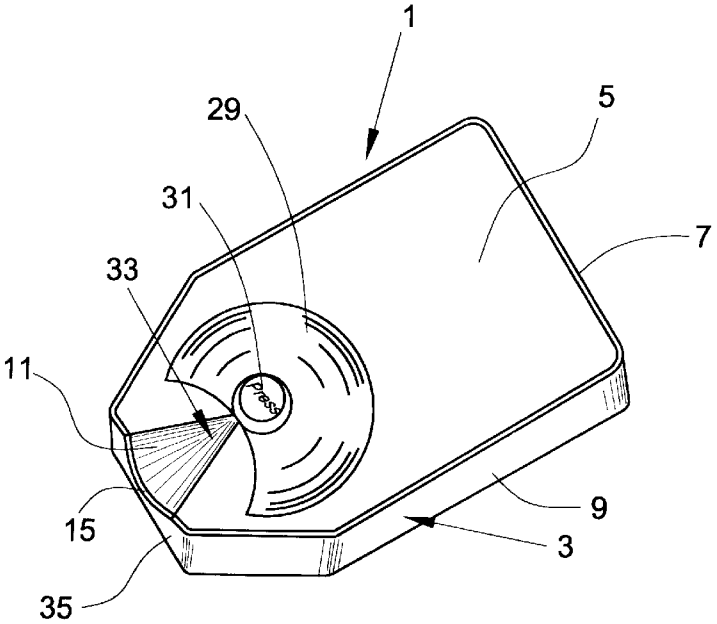

FIG. 1 illustrates an oblique top view of a present invention flat pill pack container 1 but with the gate excluded for illustrating the other aspects of the invention; FIG. 2 shows a side cut view thereof and FIG. 3 shows a top-removed oblique top view thereof. Identical parts are identically numbered and all three Figures are discussed here collectively.

Container 1 has a main container body 3 with a top 5, a bottom 17, sides, such as side 9 and back 7. Front area 35 includes a dispensing opening 15. There is a cantilevered cover shown generally as 33, with a front portion 11 and a trigger portion 31. In this embodiment a flexible, corrugated concentrical partial circle 29 is designed to flex when trigger 31 is pressed. It is supported by internal wall ring 21. Pin 19 (FIGS. 2 and 3) and pin 25 (FIG. 3) are the points of rotation—when trigger 31 is pressed down (arrow 41), front portion 11 (arrow 43) lifts up. The user would tilt the container with dispensing opening 15 lower relative to back 7. Likewise, once dispensing is completed and pill 27 has been dispensed, the gate (not shown in these Figures for simplicity of illustration only) opens, and retitling the container reloads the dispensing chamber 13 with a pill such as a pill 23 from main body 10. Subsequent pills 28 and 30, etc. are similarly dispensed. The gate concept is more fully understood in the discussions which follow herein.

Figure 6:
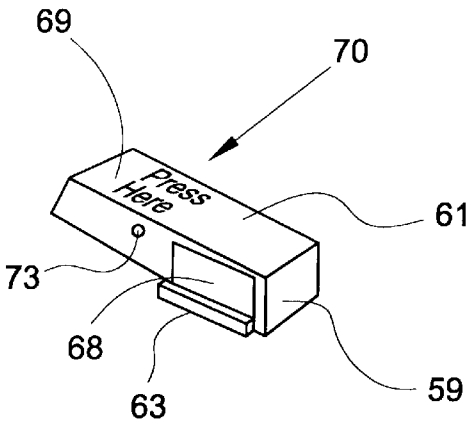
FIG. 6 a reverse oblique side view of the cover and gate used in the device shown in FIGS. 4 and 5; and, FIGS. 6 through 16 show various views and components of an alternative embodiment present flat pill pack container with a day indicator and a child-resistant safety lock.
Figure 4:
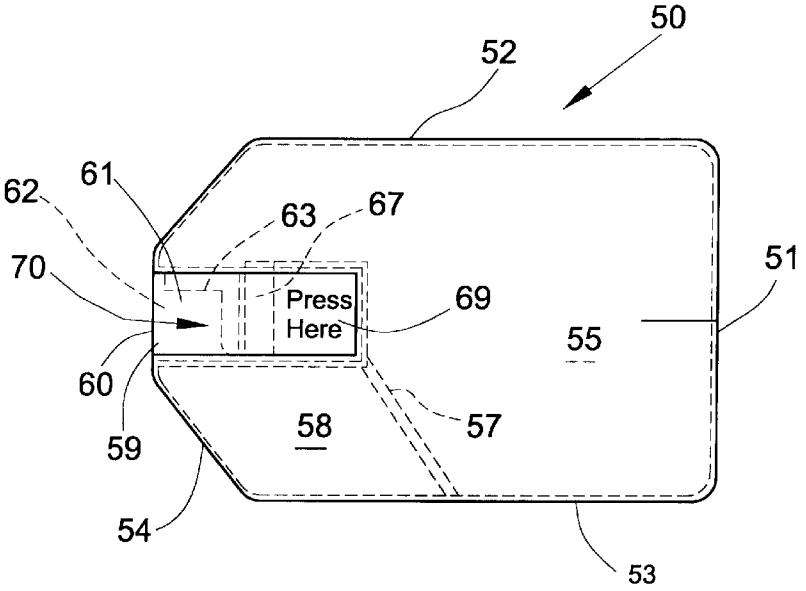
FIG. 4 shows an alternative embodiment top view of a present invention pill pack container which includes the gate mechanism.
Figure 5:
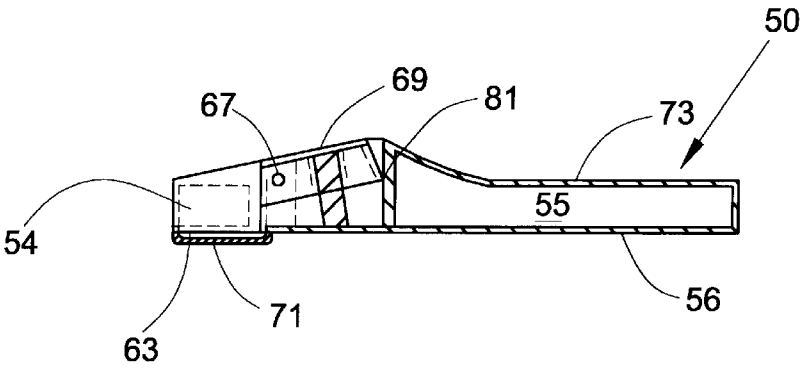
FIG. 5 shows a cut side view thereof.

FIGS. 4 and 5 show a top view and a side view respectively of another present invention dispenser 50, and FIG. 6 shows an oblique view of the details of trigger-cover 70 with gate 63 (shown in FIGS. 4 and 5). Like aspects are identically numbered in all three Figures.

Container 51 includes main body 55 with sides 52 and 53 and back 51, as well a front 54 and bottom 56. Main body 55 is an open area for pill containment with a wall 57, creating closed off section 58, not for pills, which prevents lodged pills being unable to be easily dispensed. Front 54 has a dispensing opening 60 and trigger-cover 70 has a front portion 59 which closed off opening 60. Looking at all three Figures, it can be seen that there is a dispensing chamber 62 which is also covered or contained by the trigger-cover 70 at its front top 61. Holes such as hole 73 is provided therein for pin 67. When back portion 69 of trigger-cover 70 is pressed down, front portion (59 and 61) lifts up with gate 63 likewise lifting up. This causes two occurrences simultaneously. The front portion opens the dispensing orifice 60 to permit a pill to be dispensed (dumped out) and, it lifts the gate 63 to prevent any additional pills in main body 55 from exiting. Spring 81 maintains trigger-cover 70 in its closed portion so that when a user releases end 69, the trigger-cover 70 automatically closes. Simultaneously, gate 63 drops into recess 71 and opens, permitting a pill (or pills, with dispensing chamber 62 sized as desired to hold one, two, three or more pills) to enter into dispensing chamber 62 via opening 68 in trigger-cover 70. This creates a compact, flat pill pack dispenser which is convenient to carry and store and easy to operate.

Figure 10:
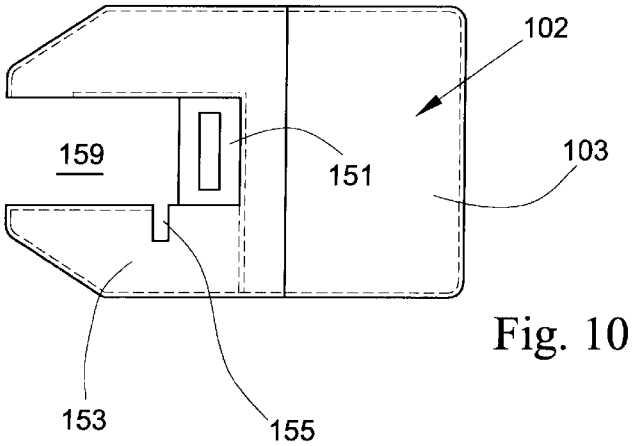
Figure 11:
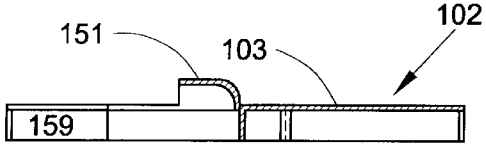
Figure 12:
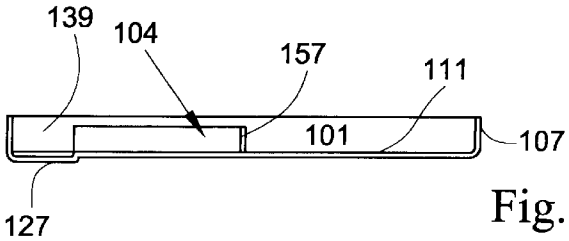
Figure 7:
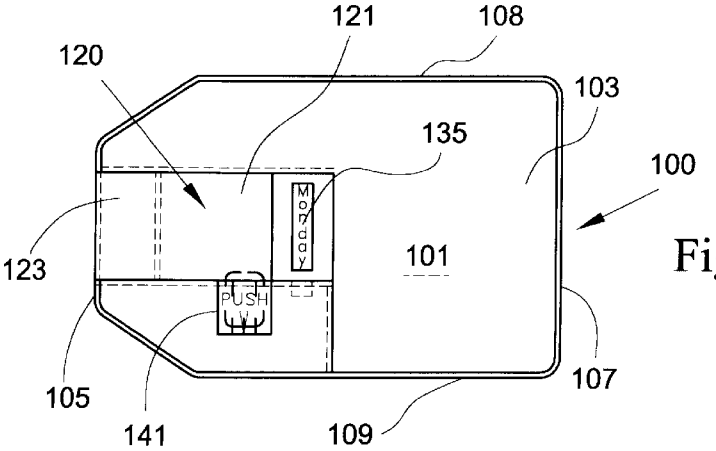
Figure 8:
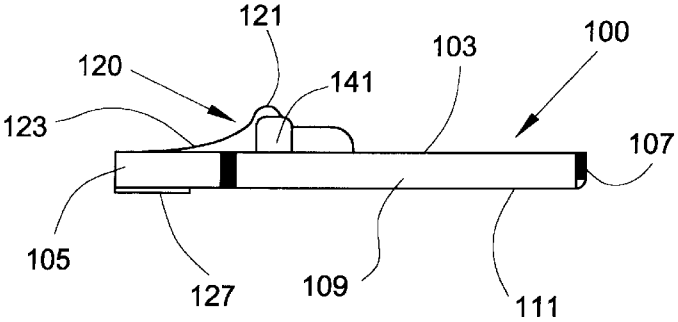
Figure 9:
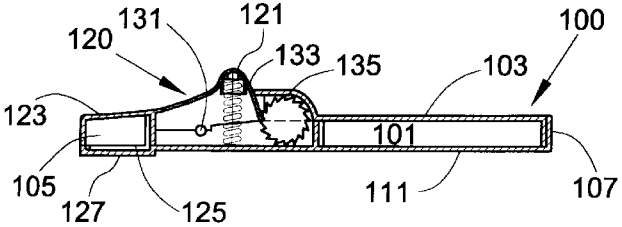

FIGS. 7, 8 and 9 show top, side and cut side views of another alternative embodiment present invention flat pill pack container 100. Container 100 has two main pieces to form its main body structure. FIG. 10 shows a top view of the top portion 102 and FIG. 11 shows a side view thereof, while FIG. 12 shows a side view of bottom portion 104.

Container 100 has a top 103, a bottom 111, sides 108 and 109, front 105 and back 107. There is a trigger-cover 120 with a trigger area 121 for depressing, and a lid portion 123 which lifts when area 121 is pressed. Spring 133 maintains trigger-cover 120 in its closed position and is opened when operated as discussed below. Child resistant safety lock 141 is a spring-loaded slider lock which must be pulled away from center in order to permit depressing area 121 for pill dispensing.

Bottom 111 has a gate recess area 127 similar to that described in conjunction with the FIGS. 4, 5 and 6 above, and gate 125 is attached to the lid portion 123 of trigger-cover 120 so that it lifts (closes) to shut off pill flow to dispensing chamber 105 when area 121 is pressed to lift (open) lid portion 123 to permit the pill(s) in chamber 105 to be dispensed. Thus trigger-cover 120 rotates at pin 131 when depressed, but can only be depressed when safety lock 141 is slid back and held.

Another feature of this embodiment is a day calendar indicator to advise the user of the last day a pill may be taken. Cylinder 135 is housed within container 100, as shown, and can be rotated backwards to be set. Each time area 121 is depressed, its rachet hammer 133 rotates cylinder 135 forward one day (hours or other indicia could be used instead, e.g. alternating DAY—AM/DAY—PM, indicating each half day of the week for pills taken twice a day).

Figure 13:
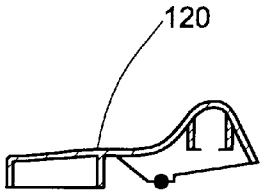
Figure 14:
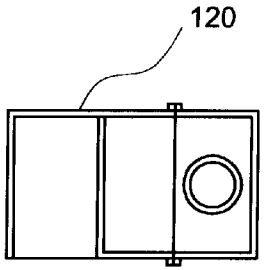
Figure 15:
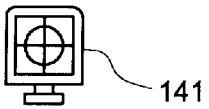
Figure 16:
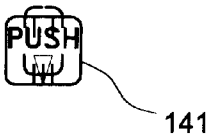

FIGS. 10 and 11 illustrate opening 159 in top portion 102, which creates, with bottom portion 104 (FIG. 12), dispensing chamber 139. Having a separate top portion 102 in FIG. 11 and a bottom portion 104 in FIG. 12 allows for easy filling and easy assembly. Back arcuate section 151 of top portion 102 partially houses cylinder 135, as shown, and stop 157 prevents pills held in 101 from entering the cylinder-trigger-cover area. In FIG. 10, left top side 153 has cut out 155 for mounting the child resistant safety lock 141. FIGS. 13 and 14 show side and bottom views of trigger-cover 120 with features more clearly illustrated, as numbered above, and FIGS. 15 and 16 likewise illustrate the side and top views of child resistant safety lock 141.

Obviously, numerous modifications and variations of the present invention are possible in light of the above teachings. For example, convenient filling approaches may be included in the design instead of separate tops and bottoms, such as seal tight fill flap and port. It is therefore understood that within the scope of the appended claims, the invention may be practiced otherwise than as specifically described herein.

What is claimed is:

1. A flat pill pack container, which comprises:

(a) a main container body having a bottom, top and sidewalls and having a predetermined internal open height adapted to receive a plurality of pills having predetermined dimensions, said main container body having a dispensing opening and having means for attaching a closed-biased, cover said main container body having a defined dispensing chamber adjacent said dispensing opening;

(b) a closed-biased cover attached to said container at said dispensing opening and having a first, closed position to prevent removal of pills from said main container body, said cover being movably attached so as to be movable to a second, open position to permit pill removal, said cover having a gate attached thereto which is positioned in a first, open position when said cover is in said first, closed position, and wherein said gate moves to a second, closed position when said cover is moved to its second, open position, thereby permitting pill movement into said dispensing chamber when said cover is closed and prevents pills from movement into said dispensing chamber when said cover is open; and (c) a child-resistant safety lock movably attached to said main container body and said cover and biased in a locked position locking said cover, so as to first require movement of said lock to an unlocked position before said cover may be opened.

2. The flat pill pack container of claim 1 wherein said cover is hinged to rotate about an axis, said gate is adapted to be cantilevered upwardly so as to simultaneously open said cover and close said gate.

3. The flat pill pack container of claim 1 wherein said main container body top has means for attaching said cover and said main container body bottom has a gate recess wherein said gate nests within said gate recess when said cover is closed and lifts up from said gate recess when said cover is opened.

4. The flat pill pack container of claim 2 wherein said main container body top has means for attaching said cover and said main container body bottom has a gate recess wherein said gate nests within said gate recess when said cover is closed and lifts up from said gate recess when said cover is opened.

5. The flat pill pack container of claim 1 wherein said dispensing chamber has a predetermined volume and includes an inlet opening of predetermined width to permit a controlled predetermined number of pills to enter into and to fit in said chamber at a time.

6. The flat pill pack container of claim 1 wherein said safety lock is a sliding lock which is biased in a locked position, preventing opening of said cover, and is slidable to a second position away from said cover to permit opening of said cover.

7. A flat pill pack container, which comprises:

(a) a main container body having a bottom, top and sidewalls and having a predetermined internal open height adapted to receive a plurality of pills having predetermined dimensions, said main container body having a dispensing opening and having means for attaching a closed-biased, cover said main container body having a defined dispensing chamber adjacent said dispensing opening;

(b) a closed-biased cover attached to said container at said dispensing opening and having a first, closed position to prevent removal of pills from said main container body, said cover being movably attached so as to be movable to a second, open position to permit pill removal, said cover having a gate attached thereto which is positioned in a first, open position when said cover is in said first, closed position, and wherein said gate moves to a second, closed position when said cover is moved to its second, open position, thereby permitting pill movement into said dispensing chamber when said cover is closed and prevents pills from movement into said dispensing chamber when said cover is open; and, (c) calendaring indicia means connected to said cover and having means to advance at least one indicia each time said cover is opened.

8. The flat pill pack container of claim 7 wherein said cover is hinged to rotate about an axis, said gate is connected to said cover and said cover is adapted to be cantilevered upwardly so as to simultaneously open said cover and close said gate.

9. The flat pill pack container of claim 7 wherein said main container body top has means for attaching said cover and said main container body bottom has a gate recess wherein said gate nests within said gate recess when said cover is closed and lifts up from said gate recess when said cover is opened.

10. The flat pill pack container of claim 8 wherein said main container body top has means for attaching said cover and said main container body bottom has a gate recess wherein said gate nests within said gate recess when said cover is closed and lifts up from said gate recess when said cover is opened.

11. The flat pill pack container of claim 7 wherein said dispensing chamber has a predetermined volume and includes an inlet opening of predetermined width to permit a controlled predetermined number of pills to enter into and to fit in said chamber at a time.

12. The flat pill pack container of claim 7 wherein said calendaring indicia means is a cylinder located on said main container body and connected to said cover, said cylinder having advancing ratchets movably in contrast with said cover so as to advance each time said cover is opened.

13. The flat pill pack container of claim 8 wherein said dispensing chamber has a predetermined volume and includes an inlet opening of predetermined width to permit a controlled predetermined number of pills to enter into and to fit in said chamber at a time.

14. The flat pill pack container of claim 7 which further includes:

(d) calendaring indicia means connected to said cover and having means to advance at least one indicia each time said cover is opened.

15. The flat pill pack container of claim 14 wherein said safety lock is a sliding lock which is biased in a locked position, preventing opening of said cover, and is slidable to a second position away from said cover to permit opening of said cover.

16. A flat pill pack container, which comprises:

(a) a main container body having a bottom, top and sidewalls and having a predetermined internal open height adapted to receive a plurality of pills having predetermined dimensions, said main container body having a dispensing opening and having means for attaching a closed-biased, cover said main container body having a defined dispensing chamber adjacent said dispensing opening;

(b) a closed-biased cover attached to said container at said dispensing opening and having a first, closed position to prevent removal of pills from said main container body, said cover being movably attached so as to be movable to a second, open position to permit pill removal, said cover having a gate attached thereto which is positioned in a first, open position when said cover is in said first, closed position, and wherein said gate moves to a second, closed position when said cover is moved to its second, open position, thereby permitting pill movement into said dispensing chamber when said cover is closed and thereby preventing pills from movement into said dispensing chamber when said cover is open; and, further wherein said cover is hinged to rotate about an axis, said gate is connected to said cover and said cover is adapted to be cantilevered so as to simultaneously open said cover and close said gate.

17. The flat pill pack container of claim 16 wherein said main container body top has means for attaching said cover and said main container body bottom has a gate recess wherein said gate nests within said gate recess when said cover is closed and lifts up from said gate recess when said cover is opened.

18. The flat pill pack container of claim 17 wherein said main container body top has means for attaching said cover and said main container body bottom has a gate recess wherein said gate nests within said gate recess when said cover is closed and lifts up from said gate recess when said cover is opened.

19. The flat pill pack container of claim 16 wherein said dispensing chamber has a predetermined volume and includes an inlet opening of predetermined width to permit a controlled predetermined number of pills to enter into and to fit in said chamber at a time.

* * * * *